US011856685B2

(12) United States Patent
Carlson et al.

(10) Patent No.: US 11,856,685 B2
(45) Date of Patent: Dec. 26, 2023

(54) STIFFENED RF LINAC COIL INDUCTOR WITH INTERNAL SUPPORT STRUCTURE

(71) Applicant: Applied Materials, Inc., Santa Clara, CA (US)

(72) Inventors: Charles T. Carlson, Cedar Park, TX (US); Aaron P. Webb, Austin, TX (US); Paul J. Murphy, Reading, MA (US); Frank Sinclair, Boston, MA (US); David Blahnik, Round Rock, TX (US)

(73) Assignee: Applied Materials, Inc., Santa Clara, CA (US)

( * ) Notice: Subject to any disclaimer, the term of this patent is extended or adjusted under 35 U.S.C. 154(b) by 173 days.

(21) Appl. No.: 17/479,313

(22) Filed: Sep. 20, 2021

(65) Prior Publication Data

US 2023/0089170 A1 Mar. 23, 2023

(51) Int. Cl.
*H05H 7/22* (2006.01)

(52) U.S. Cl.
CPC ..... *H05H 7/22* (2013.01)

(58) Field of Classification Search
CPC ..... H05H 7/02–22; H05H 9/00; H05H 9/042
See application file for complete search history.

(56) References Cited

U.S. PATENT DOCUMENTS 6,208,095 B1 * 3/2001 DiVergilio ..... H05H 7/18 315/505
6,239,541 B1 * 5/2001 Fujisawa ..... H05H 7/04 315/505
9,726,621 B1 8/2017 Bahr
10,943,767 B1 3/2021 Kowal
2012/0286702 A1 11/2012 Bazaz
2017/0232519 A1 8/2017 Pan et al.

FOREIGN PATENT DOCUMENTS

CN 110856334 A 2/2020
JP 7-29696 A 1/1995
JP H11354298 A * 12/1999

OTHER PUBLICATIONS

International Search Report and Written Opinion dated Dec. 22, 2022 in corresponding PCT application No. PCT/US2022/040771 .

* cited by examiner

*Primary Examiner* — Henry Luong
(74) *Attorney, Agent, or Firm* — NIELDS, LEMACK & FRAME, LLC.

(57) ABSTRACT

A coil inductor for use with a LINAC is disclosed. The coil inductor comprises one or more tubes, wherein each tube comprises an interior support structure to strengthen the tubes. By supporting the tube, the amount of vibration is reduced, allowing the coil to resonate at its natural frequency. In some embodiments, the interior structure comprises one or more interior walls. These interior walls may be used to create a plurality of fluid channels that allow the flow of coolant through the tubes. An end cap may be disposed on the second end of the tubes to allow fluid communication between the supply fluid channels and the return fluid channels. The first ends of the one or more tubes may be connected to a manifold that includes a supply port and a return port for the passage of coolant.

18 Claims, 10 Drawing Sheets

STIFFENED RF LINAC COIL INDUCTOR WITH INTERNAL SUPPORT STRUCTURE

FIELD

Embodiments of the present disclosure relate to a coil having an internal support structure, and more particularly, a coil for use with a LINAC.

BACKGROUND

The fabrication of a semiconductor device involves a plurality of discrete and complex processes. In some of these processes, ions are accelerated toward a workpiece. These ions may be accelerated in a number of ways. For example, electrical fields are commonly used to attract and accelerate positively charged ions.

In certain embodiments, a linear accelerator (or LINAC) may be used to accelerate these ions. In certain embodiments, a LINAC includes a plurality of RF cavities which each serve to further accelerate the ions passing therethrough. The LINAC may operate optimally when each of the RF cavities is energized at its respective resonant frequency.

This energy is typically provided by a coil which is wound to create an inductor. This inductor provides the high voltages needed by the LINAC. These coils are typically hollow and may become very hot, due to the energy that is generated. Therefore, in some embodiments, a Teflon sleeve is inserted into the coil, so as to allow cooling fluid to flow through the coil. While this cools the coil, it may create other issues. For example, the Teflon sleeve does not provide any structural support. Consequently, the coil may be subject to vibrations. It is known that the spacing between coils defines the capacitance and the inductance. Vibrations tends to change this spacing which may result in a change in the natural frequency of the coil. For example, the natural frequency is given by $\frac{1}{2}\pi\sqrt{LC}$. Thus, any change in the ratio of L to C necessarily changes the natural frequency of the coil. Under normal operation, the RF generator is supplying power at a fixed frequency, and if vibration is introduced into the coil, the natural frequency of the coil will shift as described by the above formula. When this happens, the RF generator is now providing power at a different frequency than the optimum frequency of the resonator coil and the induced voltage of the coil, the Q of the system and the efficiency will all decrease. In this case, beam current and final energy may be less than mandated.

Therefore, it would be advantageous if there were a system that is capable of providing structural support to the coils used in a LINAC. Further, it would be advantageous if this system were easily manufactured.

SUMMARY

A coil inductor for use with a LINAC is disclosed. The coil inductor comprises one or more tubes, wherein each tube comprises an interior support structure to strengthen the tubes. By supporting the tube, the amount of vibration is reduced, allowing the coil to resonate at its natural frequency. In some embodiments, the interior structure comprises one or more interior walls. These interior walls may be used to create a plurality of fluid channels that allow the flow of coolant through the tubes. An end cap may be disposed on the second end of the tubes to allow fluid communication between the supply fluid channels and the return fluid channels. The first ends of the one or more tubes may be connected to a manifold that includes a supply port and a return port for the passage of coolant.

According to one embodiment, a resonator coil for use within a linear accelerator (LINAC) is disclosed. The resonator coil comprises a tube having a first end, a second end and a spiral shaped section; wherein an interior of the tube comprises one or more interior walls to provide structural support to the tube. In some embodiments, an exterior of the tube is plated with copper. In certain embodiments, the one or more interior walls separate the interior of the tube into a plurality of fluid channels. In some embodiments, a manifold is attached to the first end of the tube, and has a supply port and a return port. In certain embodiments, the manifold is configured such that the supply port is in communication with one or more of the plurality of fluid channels, referred to as supply fluid channels; and the return port is in communication with a different one or more of the plurality of fluid channels, referred to as return fluid channels. In some embodiments, an end cap is disposed at the second end of the tube to allow fluid communication between the supply fluid channels and the return fluid channels. In certain embodiments, the interior of the tube further comprises a central conduit, physically isolated from the plurality of fluid channels. In some embodiments, a sensor is disposed proximate the second end and within the central conduit. In some embodiments, a tensioning wire is affixed to the end cap proximate the second end and passes through the central conduit to the manifold.

According to another embodiment, an ion implantation system is disclosed. The ion implantation system comprises an ion source; a mass analyzer; a buncher; and a LINAC, comprising: a plurality of accelerator electrodes; a plurality of cavities, each cavity comprising an excitation coil, and the resonator coil described above, wherein the second end of the resonator coil is in communication with one of the plurality of accelerator electrodes; and a plurality of RF generators, each in communication with a respective excitation coil.

According to another embodiment, a resonator coil for use within a linear accelerator (LINAC) is disclosed. The resonator coil comprises a first tube having a first end, a second end and a spiral shaped section; a second tube having a first end, a second end and a spiral shaped section; wherein an interior of the first tube and an interior of the second tube each comprise one or more interior walls to provide structural support to the first tube and the second tube; and a manifold, wherein the first end of the first tube and the first end of the second tube converge at the manifold. In some embodiments, the spiral shaped section of the first tube and the spiral shaped section of the second tube are concentric. In certain embodiments, the one or more interior walls separate the interior of the first tube and the interior of the second tube into a plurality of fluid channels. In some embodiments, the manifold is configured such that a supply port is in communication with one or more of the plurality of fluid channels, referred to as supply fluid channels; and a return port is in communication with a different one or more of the plurality of fluid channels, referred to as return fluid channels. In some embodiments, an end cap is disposed at the second end of the first tube and the second end of the second tube to allow fluid communication between the supply fluid channels and the return fluid channels. In certain embodiments, the interior of the first tube further comprises a central conduit, physically isolated from the plurality of fluid channels. In some embodiments, a sensor is disposed proximate the second end of the first tube and within the central conduit. In some embodiments, a tensioning wire is affixed to the end cap proximate the second end of the first tube and passes through the central conduit to the manifold.

According to another embodiment, an ion implantation system is disclosed. The ion implantation system comprises an ion source; a mass analyzer; a buncher; and a LINAC, comprising: a plurality of accelerator electrodes; a plurality of cavities, each cavity comprising an excitation coil, and the resonator coil of described above, wherein the second end of the first tube and the second end of the second tube are each in communication with one of the plurality of accelerator electrodes; and a plurality of RF generators, each in communication with a respective excitation coil.

BRIEF DESCRIPTION OF THE FIGURES

For a better understanding of the present disclosure, reference is made to the accompanying drawings, which are incorporated herein by reference and in which.

DETAILED DESCRIPTION

Figure 1:
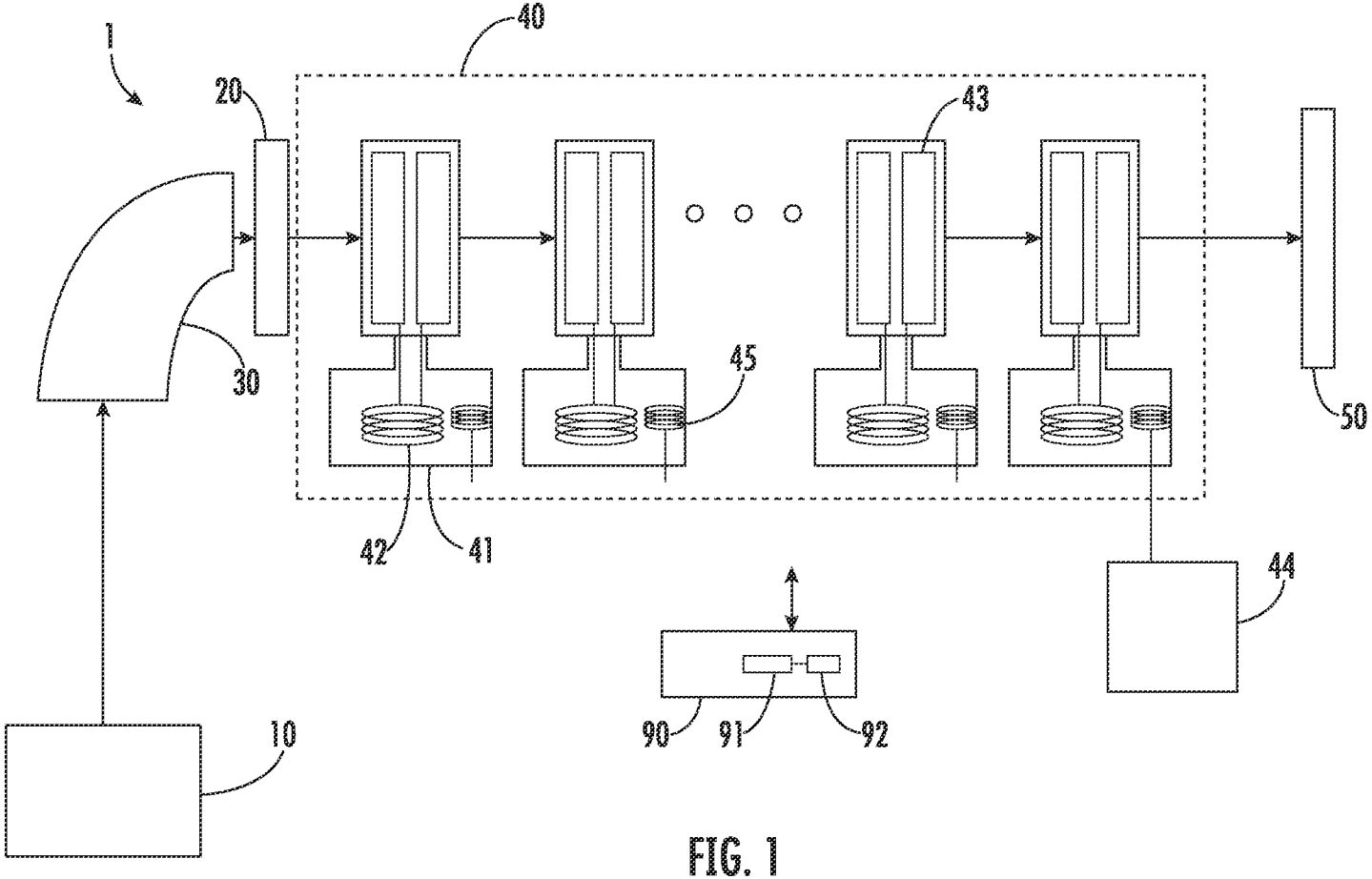
FIG. 1 shows a block diagram of the ion implantation system utilizing a linear accelerator, or LINAC, according to one embodiment.

Linear accelerators (LINACs) may be used to accelerate ions toward a workpiece. FIG. 1 shows an ion implantation system 1. The ion implantation system 1 comprises an ion source 10. The ion source 10 may be any suitable ion source, such as, but not limited to, an indirectly heated cathode (IHC) source, a Bernas source, a capacitively coupled plasma source, an inductively coupled plasma source, or any other suitable device. The ion source 10 has an aperture through which ions may be extracted from the ion source 10. These ions may be extracted from the ion source 10 by applying a negative voltage to one or more electrodes, disposed outside the ion source 10, proximate the extraction aperture.

The ions may then enter a mass analyzer 30, which may be a magnet that allows ions having a particular mass to charge ratio to pass through. This mass analyzer 30 is used to separate only the desired ions. It is the desired ions that then enter the linear accelerator 40.

The desired ions then enter a buncher 20, which creates groups or bunches of ions that travel together. The buncher 20 may comprise a plurality of drift tubes, wherein at least one of the drift tubes may be supplied with an AC voltage. One or more of the other drift tubes may be grounded. The drift tubes that are supplied with the AC voltage may serve to accelerate and manipulate the ion beam into discrete bunches.

The linear accelerator 40 comprises one or more cavities 41. Each cavity 41 comprises a resonator coil 42 that may be energized by electromagnetic fields created by an excitation coil 45. The excitation coil 45 is disposed in the cavity 41 with a respective resonator coil 42. The excitation coil 45 is energized by an excitation voltage, which may be a RF signal. The excitation voltage may be supplied by a respective RF generator 44. Each excitation coil 45 is tuned to a single resonant frequency. In other words, the excitation voltage applied to each excitation coil 45 may be independent of the excitation voltage supplied to any other excitation coil 45. Each excitation voltage is preferably modulated at the resonance frequency of its respective cavity 41. The magnitude and phase of the excitation voltage may be determined and changed by the controller 90, which is in communication with the RF generator 44. By disposing the resonator coil 42 in a cavity 41, the magnitude of the excitation voltage may be increased or phase shifted while keeping the amplitude the same.

When an excitation voltage is applied to the excitation coil 45, a voltage is induced on the resonator coil 42. The excitation voltage may be an RF voltage having a frequency between 13.56 MHz and 27 MHz. Further, the amplitude of the voltage may be between 9 kV and 170 kV. The result is that the resonator coil 42 in each cavity 41 is driven by a sinusoidal voltage. Each resonator coil 42 may be in electrical communication with two accelerator electrodes 43. The two accelerator electrodes 43 may be driven by opposite phases of the sinusoidal voltage. In other words, two accelerator electrodes 43 are driven by the voltages present on the two ends of the resonator coil 42. The ions pass through apertures in each accelerator electrode 43.

The entry of the bunch into a particular accelerator electrode 43 is timed such that the potential of the accelerator electrode 43 is negative as the bunch approaches, but switches to positive as the bunch passes through the accelerator electrode 43. In this way, the bunch is accelerated as it enters the accelerator electrode 43 and is repelled as it exits. This results in an acceleration of the bunch. This process is repeated for each accelerator electrode 43 in the linear accelerator 40. Each accelerator electrode increases the acceleration of the ions and can be measured.

After the bunch exits the linear accelerator 40, it is implanted into the workpiece 50.

Of course, the ion implantation system 1 may include other components, such as an electrostatic scanner to create a ribbon beam, quadrupole elements, additional electrodes to accelerate or decelerate the beam and other elements.

A controller 90 may be used to control the system. The controller 90 may include a processing unit 91 and a memory device 92. The processing unit 91 may be a microprocessor, a signal processor, a customized field programmable gate array (FPGA), or another suitable unit. This memory device 92 may be a non-volatile memory, such as a FLASH ROM, an electrically erasable ROM or other suitable devices. In other embodiments, the memory device 92 may be a volatile memory, such as a RAM or DRAM. The memory device 92 comprises instructions that enable the controller 90 to control the linear accelerator 40.

Figure 2A:
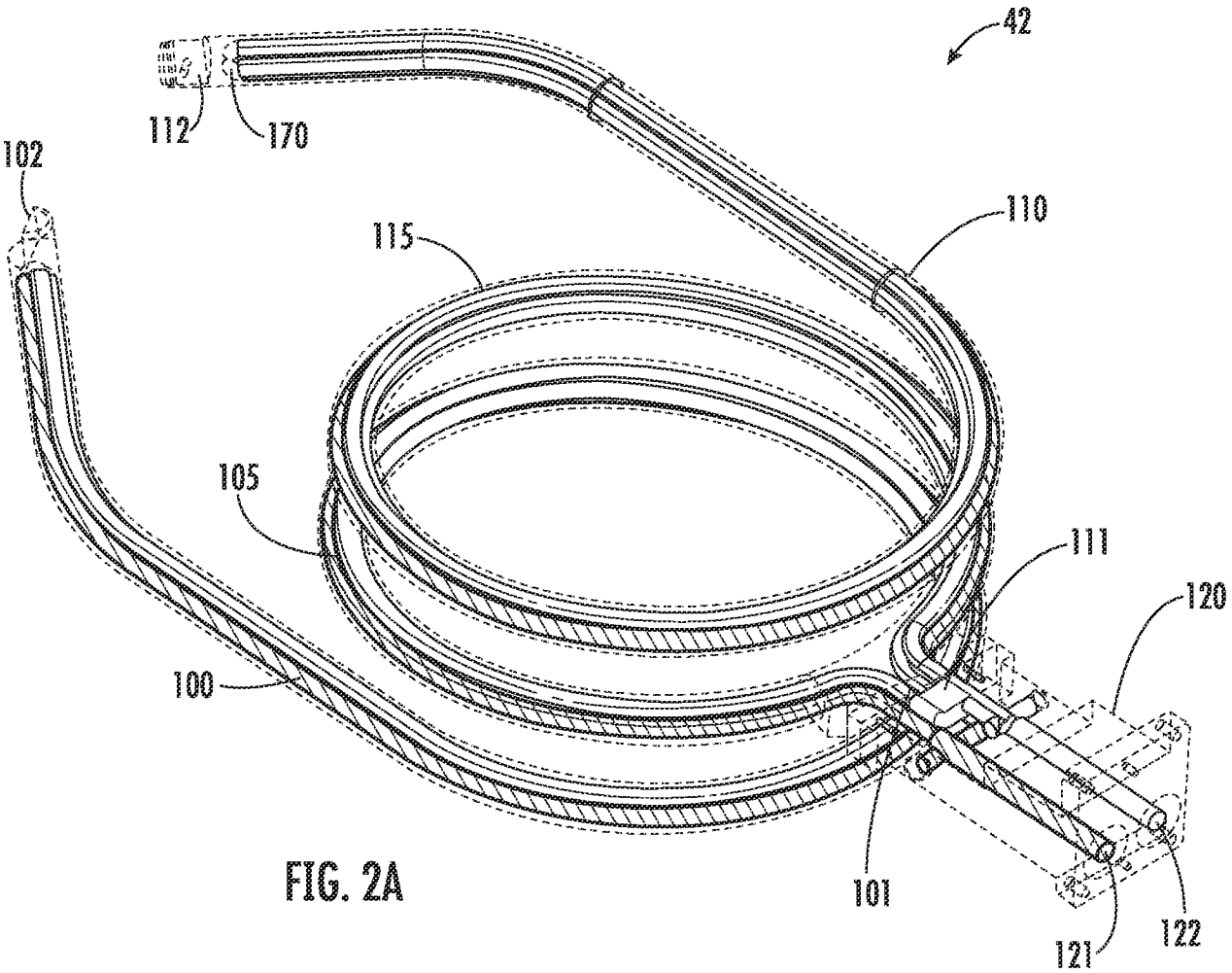
FIGS. 2A-2B show two views of a resonator coil according to the embodiment of FIG. 1.
Figure 2B:
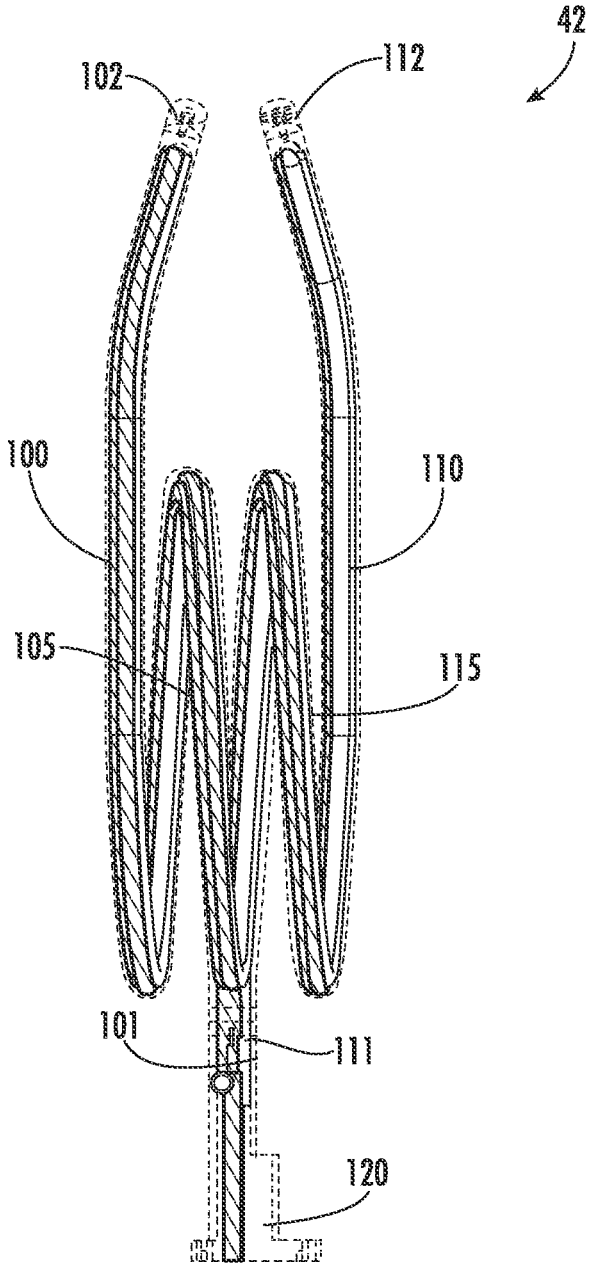

A representative resonator coil 42 is shown in FIGS. 2A-2B. FIG. 2A is a perspective view, while FIG. 2B shows the resonator coil 42 as it may be mounted within the cavity 41. The resonator coil 42 may be constructed of any suitable material, such as aluminum, stainless steel, titanium or other metals. In certain embodiments, the cross section of the resonator coil 42 may be a circle. As described above, the resonator coil 42 comprises two ends which are connected to two accelerator electrodes 43.

The resonator coil 42 may comprise a first tube 100 and a second tube 110. A first end 101 of the first tube 100 and a first end 111 of the second tube 110 converge at a manifold 120. The second end 102 of the first tube 100 and the second end 112 of the second tube 110 form two exposed prongs.

The first tube 100 and the second tube 110 each comprise a spiral shaped section 105. The spiral shaped section 105 may comprise one or more loops. For example, there may be between 1 and 2.5 loops in each spiral shaped section 105, although other numbers are also possible. Further, the spiral shaped section 105 of the first tube 100 and the spiral shaped section 115 of the second tube 110 overlap one another so as to form an inductor. In other words, the spiral shaped section comprises one or more loops having a center and the loops of the two spiral shaped sections are concentric.

Of course, the resonator coil 42 may have other shapes and forms.

Figure 4A:
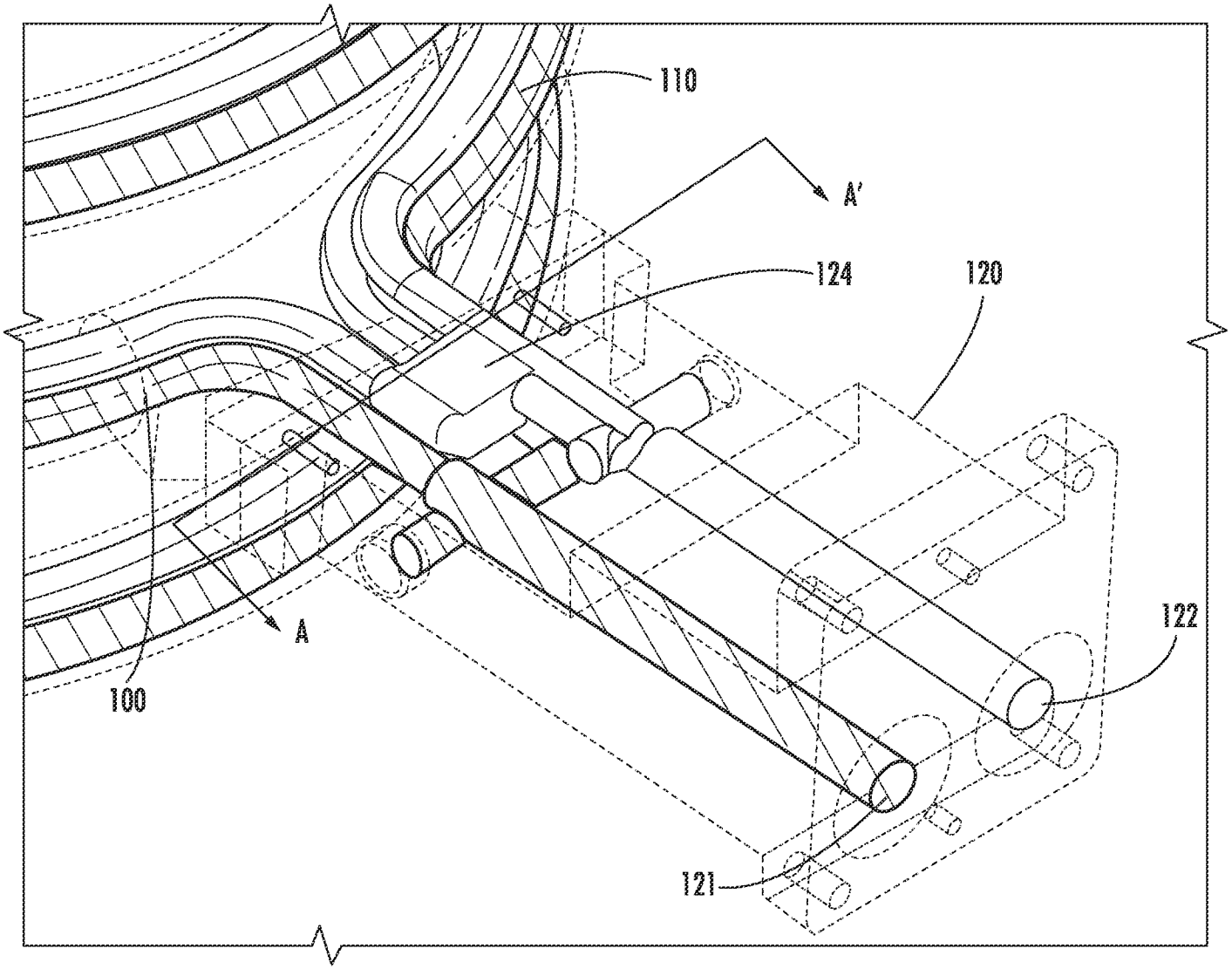
FIG. 4A-4C show different views of the manifold.
Figure 4B:
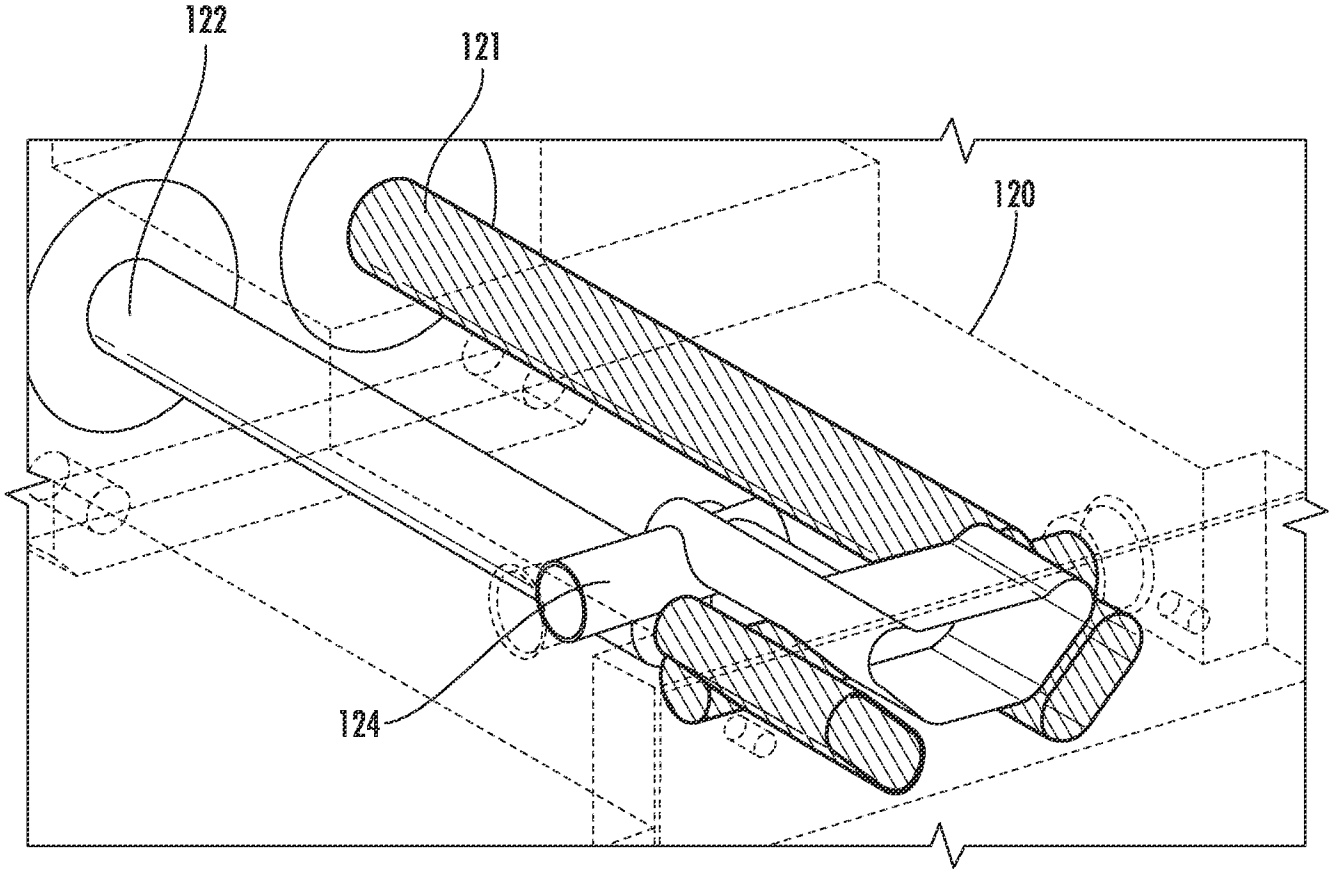
Figure 4C:
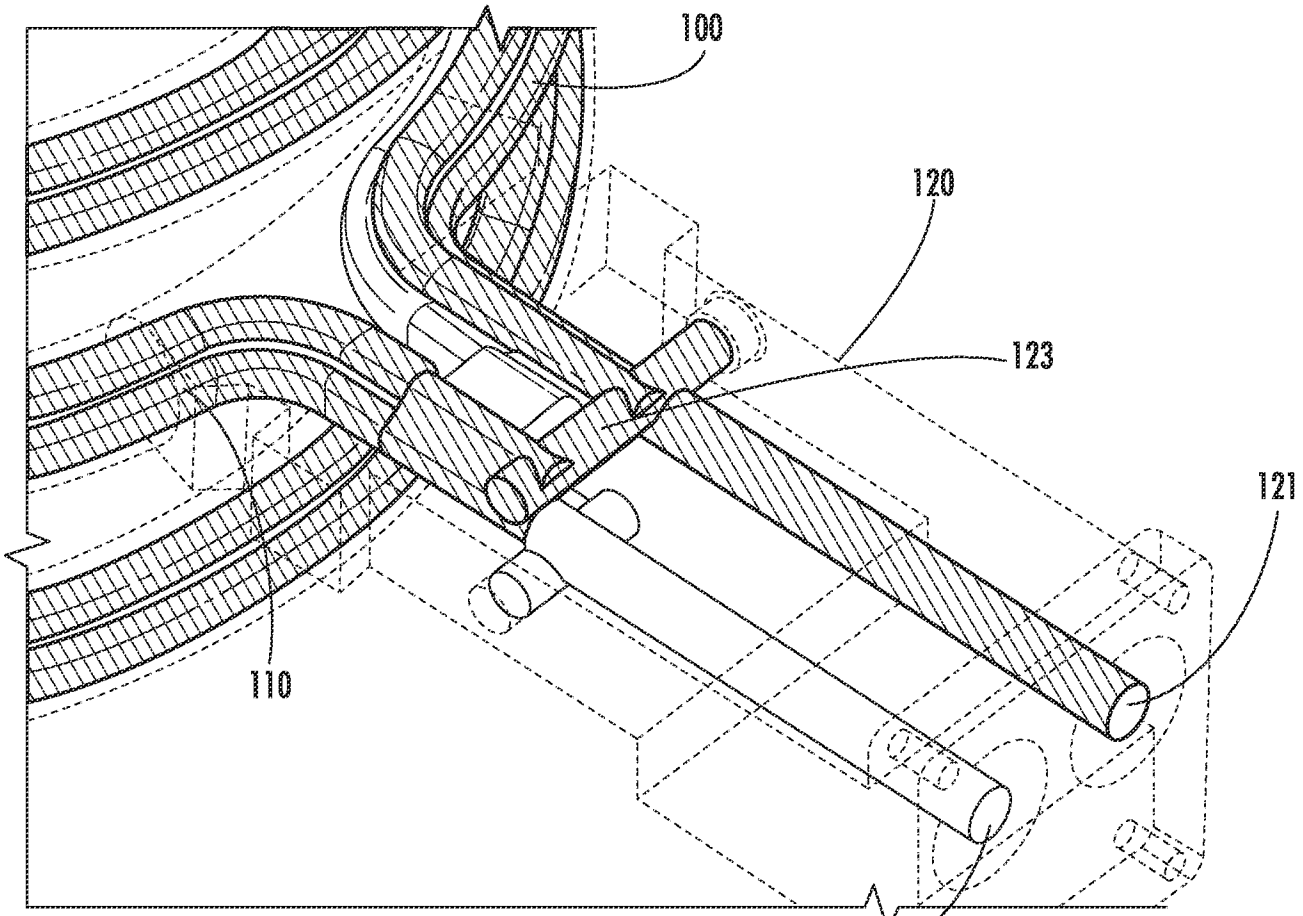

The manifold 120 is used to hold the first tube 100 and the second tube 110 and also contains the channels used to create the supply fluid channels and the return fluid channels. FIG. 4A shows a perspective view of the top of the manifold 120, and FIG. 4B shows a cross-section view of the manifold 120, taken along line A-A'. FIG. 4C shows a perspective view of the bottom of the manifold 120.

In one embodiment, the manifold 120 has two ports; a supply port 121 and a return port 122. As best seen in FIG. 4C, the manifold includes a first internal junction 123 to route the fluid from the supply port 121 to some of the fluid channels in the first tube 100 and to some of the fluid channels in the second tube 110. Similarly, as best seen in FIG. 4A, the manifold 120 includes a second internal junction 124 to route the rest of the fluid channels in the first tube 100 and in the second tube 110 to the return port 122. In other embodiments, the manifold 120 may comprise two supply ports 121 and two return ports 122 so that the internal junctions are not used.

Figure 3A:
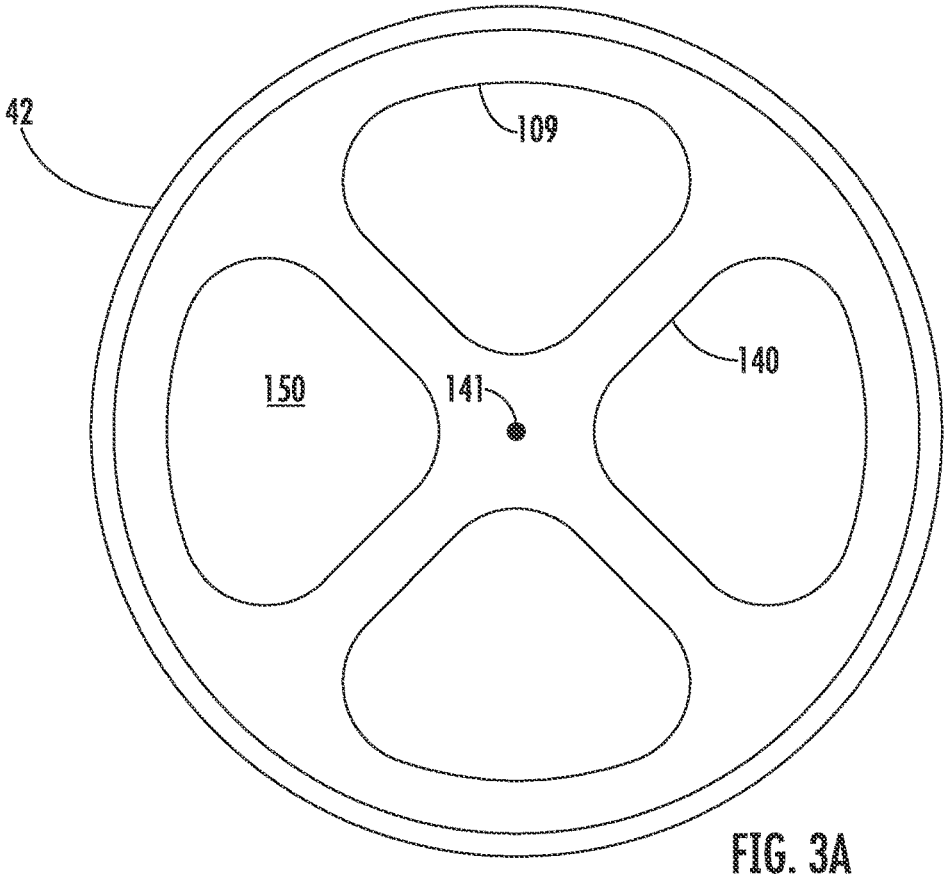
FIG. 3A shows a cross section of the resonator coil of FIG. 2 according to one embodiment.

FIG. 3A shows a representative cross-section of the resonator coil 42 according to one embodiment. The interior of the resonator coil 42 is divided into a plurality of different fluid channels 150. The fluid channels 150 may be physically isolated from one another throughout the length of the tube and may only connect to one another at the second end, as described in more detail below. In certain embodiments, the number of fluid channels 150 is even, such that there are the same number of fluid channels 150 supplying coolant from the manifold 120 (referred to as supply fluid channels) as there are fluid channels 150 returning that coolant back to the manifold 120 (referred to as return fluid channels). These fluid channels 150 are created by an internal structure having one or more interior walls 140 that extend from one part of the inner diameter 109 of the resonator coil 42 to another part of the inner diameter 109. In certain embodiments, the interior walls 140 pass through the center 141 of the circle that defines the cross section of the resonator coil 42. Further, in certain embodiments, the interior walls 140 are straight, such that each interior wall 140 is a diameter of the circle.

In other embodiments, the number of fluid channels 150 may be odd. In these embodiments, the interior walls 140 may be radii of the circle, extending from a part of the inner diameter 109 to the center 141 of the circle. In this case, each interior wall 140 may join with other interior walls 140 at the center 141 of the circle. For example, if there are an odd number of equally sized fluid channels, each interior wall 140 will extend from the inner diameter 109 to the center 141 of the circle, where it joins with other interior walls 140.

In yet other embodiments, the interior walls 140 may not pass through the center 141 of the circle. For example, the circle may be separated into separate fluid channels by a plurality of parallel interior walls.

As an example, FIG. 3A shows a cross section where there are an even number of fluid channels 150 that are defined by two interior walls 140 that pass from one part of the inner diameter 109 to a second part of the inner diameter 109 passing through the center 141 of the circle. Further, in this embodiment, the interior walls 140 are equally spaced apart, such that all of the fluid channels 150 have the same cross-sectional area.

In certain embodiments, the sum of the cross-sectional areas of all of the supply fluid channels may be equal to the sum of the cross-sectional areas of all of the return fluid channels. In some embodiments, the total cross-sectional area of the supply fluid channels may be slightly greater than the total cross-sectional area of the return fluid channels.

In all embodiments, these interior walls 140 are made of the same material as the resonator coil 42 and are manufactured at the same time. For example, in one embodiment, the resonator coil 42 may be extruded with the pattern shown in FIG. 3A. In another embodiment, the resonator coil 42 may be manufactured using additive manufacturing, where the interior walls 140 are created at the same time. In this way, the interior walls 140 provide structural support for the resonator coil 42 and serve to damp any vibrations.

The tubes of the resonator coil 42 has an outer diameter and an inner diameter and each interior wall 140 may have a thickness. The thickness of the interior walls 140 may be a function of the inner diameter. In other words, as the inner diameter grows, it may be advantageous to have thicker interior walls to maintain the structural stiffness. In certain embodiments, the inner diameter of the resonator coil 42 may be between 0.75 and 1.25 inches. In this configuration, the thickness of the interior walls may be between 0.05 and 0.050 inches. Of course, other dimensions are also possible.

Figure 3B:
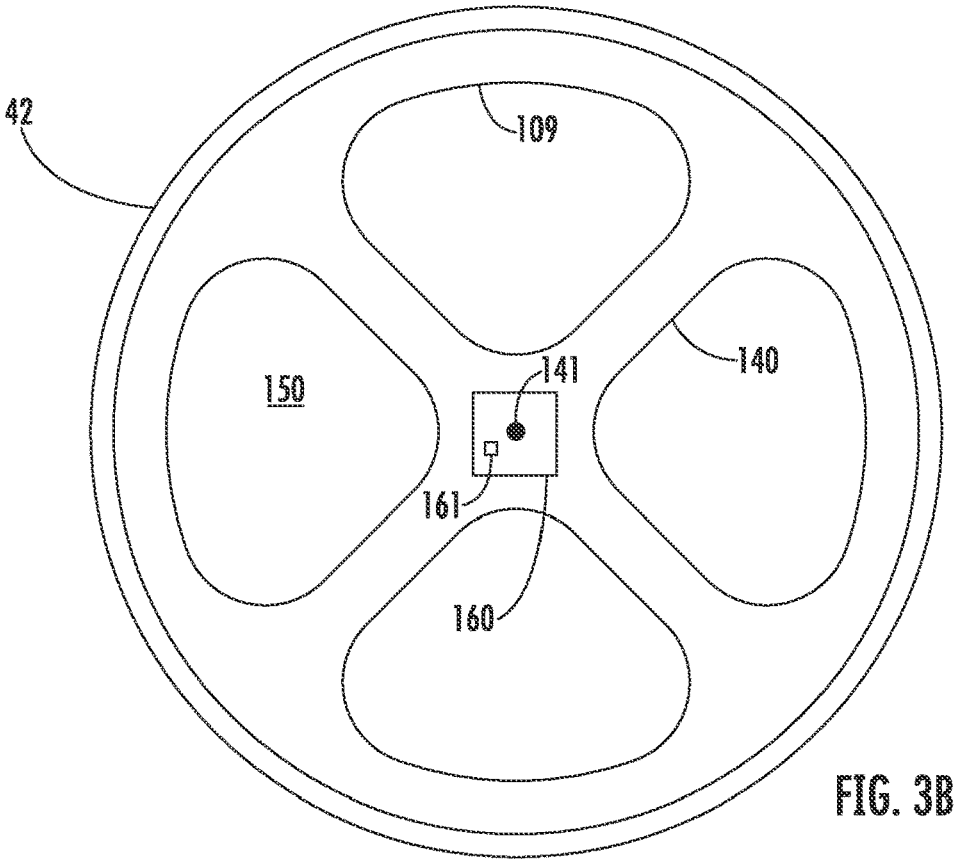
FIG. 3B shows a cross section of the resonator coil of FIG. 2 according to another embodiment.

FIG. 3B shows the cross section of the tubes of the resonator coil 42 according to another embodiment. In this embodiment, there is a central conduit 160 in the resonator coil 42. In certain embodiments, this central conduit 160 does not contact the inner diameter 109. The central conduit 160 is physically separate from the other fluid channels 150. In some embodiments, such as is shown in FIG. 3B, the central conduit 160 is formed about the center 141 of the resonator coil 42, in the region where the interior walls 140 meet.

This central conduit 160 may be used for a various of functions. Unlike the other fluid channels, the central conduit may be isolated such that coolant does not flow through the central conduit 160. In one embodiment, a sensor 161 may be placed at or near the second end 102 of the first tube 100 and/or second end 112 of the second tube 110. This sensor 161 may be a temperature sensor, a voltage sensor, or another type of sensor. The electrical connections for this sensor 161 may travel through the central conduit 160 to the manifold 120. Once outside the manifold 120, the electrical connections may be joined to a suitable circuit or apparatus to measure the parameter being monitored by the sensor 161.

In another embodiment, a tensioning wire may be installed in the central conduit 160. This tensioning wire may be used to increase or decrease the stiffness of the resonator coil 42. For example, one end of the tensioning wire may be attached to the end cap 170 at the second end 102 and the other end of the tensioning wire may be accessible at the manifold 120. By pulling the end of the tensioning wire at the manifold 120, the stiffness of the resonator coil 42 may be increased.

In certain embodiments, such as that shown in FIG. 2A, the resonator coil 42 comprises four fluid channels. The supply fluid channels are disposed adjacent to one another, as are the return fluid channels.

Figure 5A:
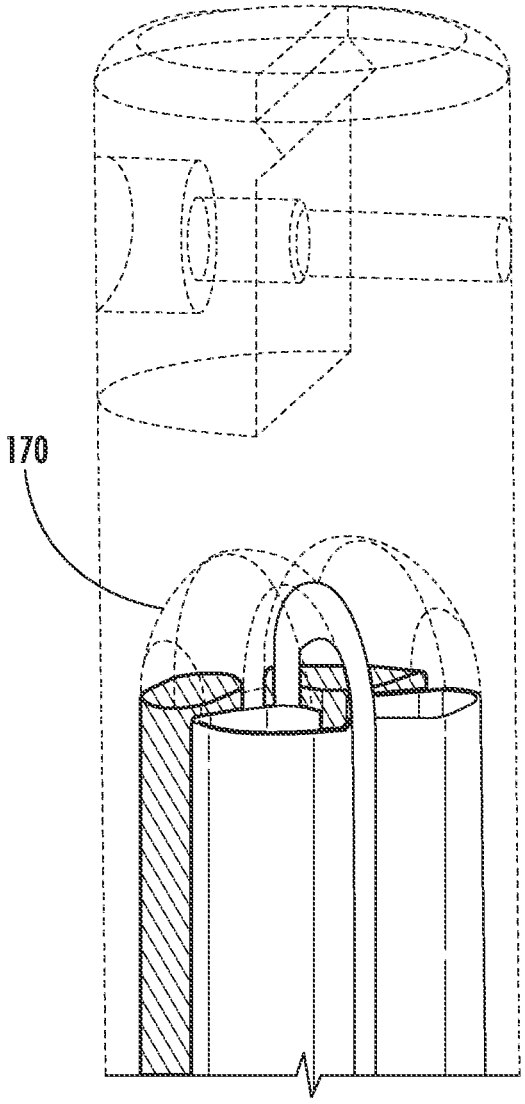
FIG. 5A-5B show different views of an end cap according to one embodiment.
Figure 5B:
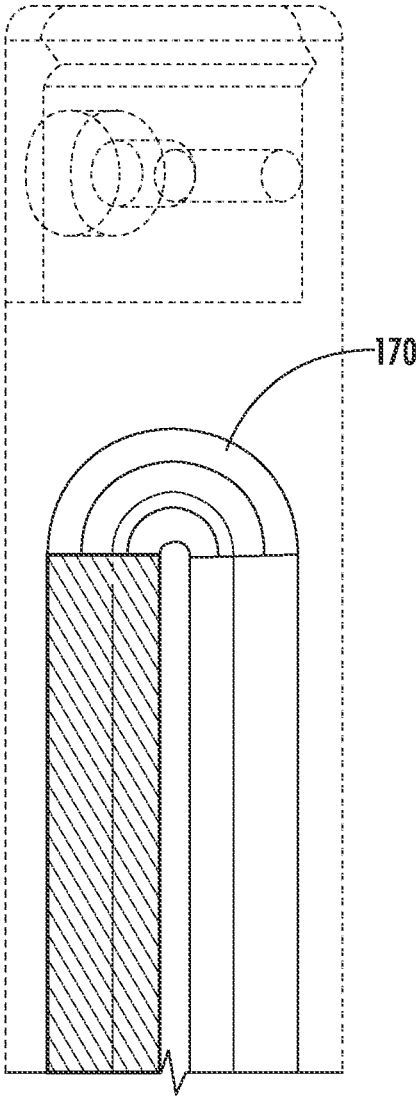

Further, as shown in FIG. 5A-5B, end caps 170 may be disposed on the second end 102 of the first tube 100 and on the second end 112 of the second tube 110. FIG. 5A shows a perspective view, while FIG. 5B shows a cross-sectional view. The end caps 170 are configured to allow communication between the supply fluid channels and the return fluid channels in the resonator coil 42. In certain embodiments, the end caps 170 are configured such that one supply fluid channel is in communication with one return fluid channel. In other embodiments, a 1:1 relationship may not exist.

Through the use of the end caps 170, coolant that enters into resonator coil 42 through the supply fluid channels is able to enter the return fluid channels at the second end 102 and the second end 112. In certain embodiments, such as that shown in FIG. 3B, the end cap 170 may be designed such that the central conduit 160 remains physically separated from the fluid channels 150. For example, a plug may be installed at the end of the tube near the end caps 170 to isolate the central conduit 160.

In operation, a fluid, such as glycol, water or a combination of these fluids, may be used as the coolant. The coolant enters the resonator coil 42 through the supply port 121 in the manifold 120, passes through the supply fluid channels until it reaches the second end 102 of the first tube 100 and the second end 112 of the second tube 110. At this point, because of the configuration of the end caps 170, the coolant enters the return fluid channels and is returned to the return port 122 on the manifold 120.

As mentioned above, the resonator coil 42 described herein may be manufactured in a number of ways. In one embodiment, a tube having the interior walls 140 described herein is extruded, such as in lengths of up to 20 feet. This tube, when extruded, is straight. An inductive bender may then be used to create the spiral shaped section 105. The inductive bender uses an inductive heater to bring the metal to a temperature at which is malleable. The specific shape of the resonator coil 42 can be created in this manner, as is well known in the art. After the tube has been properly shaped, an electrostatic plating process may be used to coat the exterior of the tube with copper. The shaped and plated tube can then be assembled with the manifold 120. Further, end caps 170 can be disposed on the second end 102 of the first tube 100 and the second end 112 of the second tube 110.

Alternatively, the tube of the resonator coil 42 may be manufactured using additive manufacturing. In this embodiment, the tube may be printed in its final shape such that inductive bending is not used. Again, an electrostatic plating process may be used to coat the exterior of the tube with copper. The shaped and plated tube can then be assembled with the manifold 120. Further, the end caps 170 may be created using additive manufacturing at the same time as the rest of the tube, such that the end caps 170 are part of the assembly.

Figure 6:
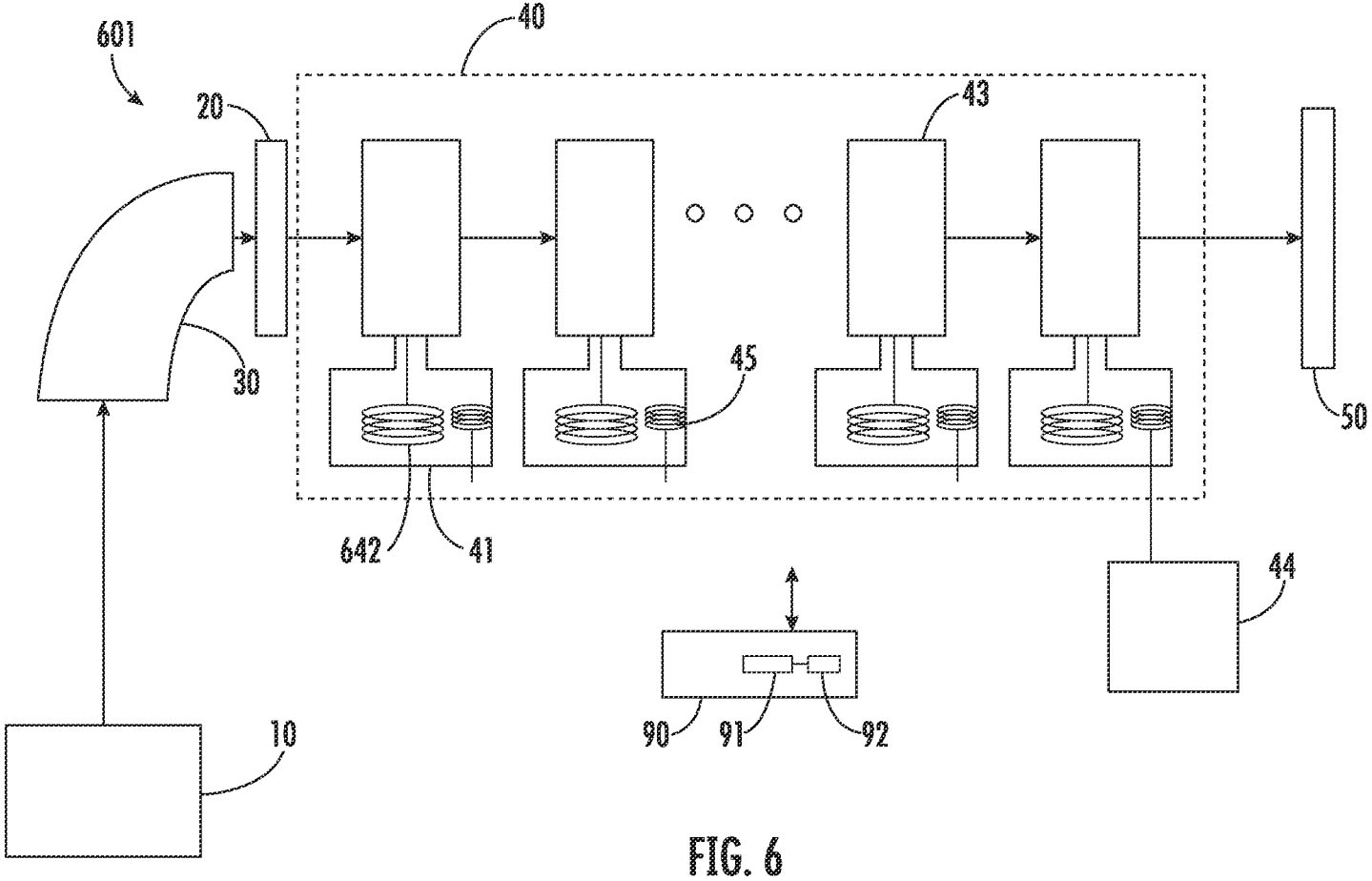
FIG. 6 shows a block diagram of an ion implantation system utilizing a LINAC according to another embodiment.

The internal structure described herein may be utilized with other embodiments as well. FIG. 6 shows an ion implantation system 601 according to another embodiment. Components that also appear in FIG. 1 are given identical reference numbers and are not described again. In this embodiment, each resonator coil 642 is only in electrical communication with one accelerator electrode 43. Therefore, unlike the resonator coil 42 of FIG. 2A, in this embodiment, the resonator coil 642 only has one exposed prong. Specifically, unlike the resonator coil of FIG. 2, the resonator coil 642 only comprises a first tube 700.

Figure 7A:
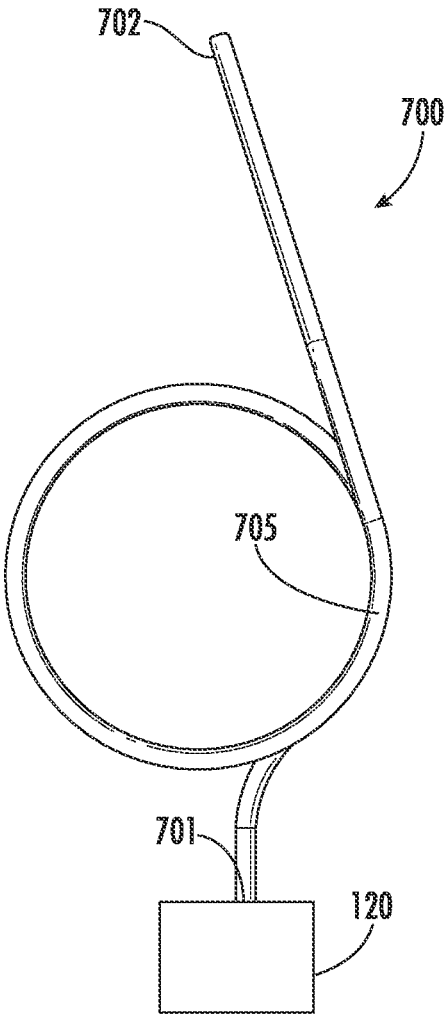
FIG. 7A-7B show two views of a resonator coil according to the embodiment of FIG. 6.
Figure 7B:
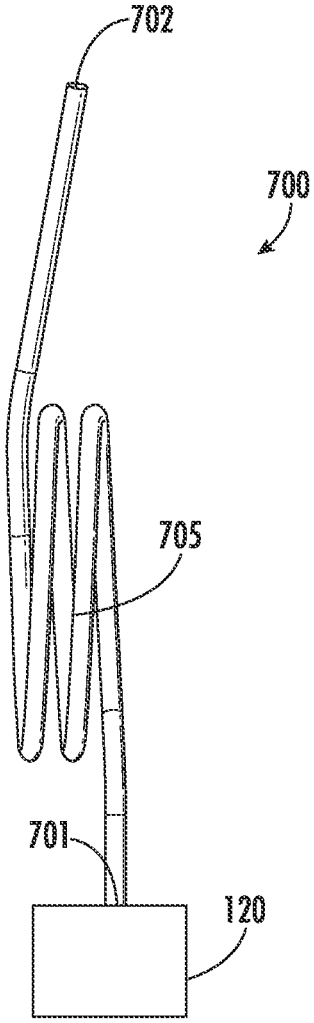

As shown in FIGS. 7A-7B, the first end 701 of the first tube 700 may converge at a manifold 120. The second end 702 of the first tube 700 forms the exposed prong.

The first tube 700 comprises a spiral shaped section 705. The spiral shaped section 705 of the first tube 700 forms an inductor. As described above, the spiral shaped section 705 may have between 1 and 2.5 loops, although other numbers are also possible.

Further, as described above, an end cap may be disposed on the second end 702, allowing the fluid that passes through the supply fluid channels to enter the return fluid channels and return to the first end 701. A manifold 120, similar to that shown in FIG. 4A, may be used to provide the supply port and the return port, as well as the interface for any electrical connections. In certain embodiments, the manifold 120 may be same as that shown in FIGS. 4A-4C, with several of the outlets plugged. In other embodiments, a different manifold which does not include the internal junctions may be used.

Further, the first tube 700 may have a cross section similar to that shown in FIG. 3A or FIG. 3B. As described above, if the cross section is as shown in FIG. 3B, a sensor or tensioning wire may be inserted in the central conduit 160.

The present system has many advantages. First, the interior walls 140 provide additional structural support for the resonator coil 42. As explained above, vibration tends to modify the ratio of inductance to capacitance, which changes the natural frequency of the resonator coil 42. The RF generator 44 is tuned to supply an RF voltage at the natural frequency of the resonator coil 42. If the vibration is such that the natural frequency is shifted, the energy transfer is less efficient, resulting in lower performance. Additionally, the fluid channels allow efficient circulation of coolant through the tubes. Additionally, the central conduit allows the option of including a sensor or tensioning wire.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. A resonator coil for use within a linear accelerator (LINAC), comprising:

a tube having a first end, a second end and a spiral shaped section;

wherein an interior of the tube comprises one or more interior walls to provide structural support to the tube, wherein the one or more interior walls separate the interior of the tube into a plurality of fluid channels and the interior of the tube further comprises a central conduit, physically isolated from the plurality of fluid channels.

2. The resonator coil of claim 1, wherein an exterior of the tube is plated with copper.

3. The resonator coil of claim 1, further comprising a manifold attached to the first end of the tube, and having a supply port and a return port.

4. The resonator coil of claim 3, wherein the manifold is configured such that the supply port is in communication with one or more of the plurality of fluid channels, referred to as supply fluid channels; and the return port is in communication with a different one or more of the plurality of fluid channels, referred to as return fluid channels.

5. The resonator coil of claim 4, further comprising an end cap disposed at the second end of the tube to allow fluid communication between the supply fluid channels and the return fluid channels.

6. The resonator coil of claim 1, further comprising a sensor disposed proximate the second end and within the central conduit.

7. The resonator coil of claim 5, further comprising a tensioning wire affixed to the end cap proximate the second end and passing through the central conduit to the manifold.

8. An ion implantation system, comprising:
an ion source;
a mass analyzer;
a buncher; and
a LINAC, comprising:
a plurality of accelerator electrodes;
a plurality of cavities, each cavity comprising an excitation coil, and the resonator coil of claim 1, wherein the second end of the resonator coil is in communication with one of the plurality of accelerator electrodes; and
a plurality of RF generators, each in communication with a respective excitation coil.

9. A resonator coil for use within a linear accelerator (LINAC), comprising:
a first tube having a first end, a second end and a spiral shaped section;
a second tube, separate from the first tube, having a first end, a second end and a spiral shaped section;
wherein the spiral shaped section of the first tube and the spiral shaped section of the second tube are concentric;
wherein an interior of the first tube and an interior of the second tube each comprise one or more interior walls to provide structural support to the first tube and the second tube; and
a manifold, wherein the first end of the first tube and the first end of the second tube converge at the manifold.

10. The resonator coil of claim 9, wherein the one or more interior walls separate the interior of the first tube and the interior of the second tube into a plurality of fluid channels.

11. The resonator coil of claim 10, wherein the manifold is configured such that a supply port is in communication with one or more of the plurality of fluid channels, referred to as supply fluid channels; and a return port is in communication with a different one or more of the plurality of fluid channels, referred to as return fluid channels.

12. The resonator coil of claim 11, further comprising an end cap disposed at the second end of the first tube and the second end of the second tube to allow fluid communication between the supply fluid channels and the return fluid channels.

13. An ion implantation system, comprising:
an ion source;
a mass analyzer;
a buncher; and
a LINAC, comprising:
a plurality of accelerator electrodes;
a plurality of cavities, each cavity comprising an excitation coil, and the resonator coil of claim 11, wherein the second end of the first tube and the second end of the second tube are each in communication with one of the plurality of accelerator electrodes; and
a plurality of RF generators, each in communication with a respective excitation coil.

14. A resonator coil for use within a linear accelerator (LINAC), comprising:
a tube having a first end, a second end and a spiral shaped section;
wherein a cross section of the tube is a circle; and
wherein an interior of the tube comprises one or more interior walls extending from an inner diameter of the tube to provide structural support to the tube, wherein the one or more interior walls create at least two fluid channels within the tube.

15. A resonator coil for use within a linear accelerator (LINAC), comprising:
a tube having a first end, a second end and a spiral shaped section;
wherein a cross section of the tube is a circle; and
wherein an interior of the tube comprises one or more interior walls extending from an inner diameter of the tube to provide structural support to the tube, wherein the one or more interior walls create at least two fluid channels within the tube, and wherein an end cap is disposed at the second end of the tube to allow fluid communication between the at least two fluid channels, so as to create supply fluid channels and return fluid channels.

16. The resonator coil of claim 15, wherein the manifold is configured such that the supply port is in communication with one or more of the at least two fluid channels, referred to as the supply fluid channels; and the return port is in communication with a different one or more of the at least two fluid channels, referred to as the return fluid channels.

17. The resonator coil of claim 14, wherein more than two fluid channels are created by the one or more interior walls.

18. An ion implantation system, comprising:
an ion source;
a mass analyzer;
a buncher; and
a LINAC, comprising:
a plurality of accelerator electrodes;
a plurality of cavities, each cavity comprising an excitation coil, and the resonator coil of claim.

* * * * *